United States Patent [19]

Reichardt et al.

[11] Patent Number: 4,975,086

[45] Date of Patent: Dec. 4, 1990

[54] CONTACT SPRING, SET OF CONTACT SPRINGS AND CHIPCARD READER USING SAID CONTACT SPRINGS

[75] Inventors: Manfred Reichardt, Weinsberg; Robert Bleier, Untergruppenbach, both of Fed. Rep. of Germany

[73] Assignee: Amphenol Corporation, Wallingford, Conn.

[21] Appl. No.: 410,832

[22] Filed: Sep. 22, 1989

[30] Foreign Application Priority Data

Sep. 24, 1988 [DE] Fed. Rep. of Germany ..... 3832588

[51] Int. Cl.[5] ..... H01R 13/00

[52] U.S. Cl. ..... 439/629

[58] Field of Search ..... 439/629–637

[56] References Cited

U.S. PATENT DOCUMENTS

| | | | |
|---|---|---|---|
| 3,464,054 | 8/1969 | Mansfield | 439/637 |
| 3,676,926 | 7/1972 | Kendall | 29/625 |
| 4,274,699 | 6/1981 | Kiem | 439/637 |
| 4,288,140 | 9/1981 | Griffith et al. | 339/74 R |
| 4,735,578 | 4/1988 | Reichardt et al. | 439/152 |
| 4,752,234 | 6/1988 | Reichardt et al. | 439/260 |
| 4,770,639 | 9/1988 | Lau | 439/61 |

FOREIGN PATENT DOCUMENTS

| | | | |
|---|---|---|---|
| 2255748 | 5/1973 | Fed. Rep. of Germany . | |
| 2537512 | 2/1977 | Fed. Rep. of Germany | 439/637 |
| 48-5556 | 2/1973 | Japan | 439/630 |
| 1424882 | 2/1976 | United Kingdom | 439/636 |

*Primary Examiner*—Joseph H. McGlynn

*Attorney, Agent, or Firm*—Bacon & Thomas

[57] ABSTRACT

A contact element is adapted to be efficiently mounted in a contact support which, in turn, can be used in a chipcard reader. The contact spring may readily inserted into the contact support such that the contact spring is, after insertion, in a biased condition.

42 Claims, 4 Drawing Sheets

CONTACT SPRING, SET OF CONTACT SPRINGS AND CHIPCARD READER USING SAID CONTACT SPRINGS

Description

1. Technical Field

This invention relates generally to a contact spring and, more particularly, to a set of biased contact springs. The invention further relates to a chipcard reader using such set of contact springs. The set of contact springs can also be used as a connector specifically for flexible printed circuits.

2. Background Art

A large variety of different types of contact springs as well as sets of contact springs are known. Sets of contacts springs for contacting the contact areas of chipcards are known, for instance, from the German laid-open applications 35 31 318.8 and 36 02 668.9. The sets of contact elements for chipcards have to be designed such that the wear of the contact areas of the chipcards as well as the wear of the contact springs is kept small. For that reason, either the chipcard is pivoted towards a stationary set of contact elements or, conversely, a set of contact elements is pivoted towards the contact areas of a stationary chipcard. Such designs handle the contact springs and he contact areas carefully, but are complicated and thus expensive to manufacture. Moreover, the complicated designs can cause mechanical as well as electrical problems.

Attention is also drawn to U.S. Pat. Nos. 4,770,639, 3,676,926 and 4,288,140 as well as German laid-open application

SUMMARY OF THE INVENTION

The present invention is directed to overcoming one or more of the problems as set forth above.

It is one object of the present invention to provide a contact spring as well as a set of contact springs adapted to be manufactured in large quantities at low cost. In accordance with another object of the invention a good contacting effect is to be achieved. In accordance with a still further object of the invention, the contact springs as well as the set of contact springs are designed such that they can easily be assembled, without requiring that the contact springs be surrounded by material during molding.

In one aspect of the present invention the contact springs are of such a design that they can be used together with a contact support into which a plurality of contact springs is simultaneously inserted and mounted in accordance with the so-called "comb assembly technique". The comb assembly technique is a method according to which a plurality of contact springs, still attached to a common support strip, are simultaneously inserted and located in the contact support. The contact support is preferably a single piece component.

Preferably, the contact springs are biased after they are inserted into the contact support such that the spring characteristic starts with values F of the force being larger than zero.

In a second aspect of the present invention, a contact spring is provided which provides for a sliding contacting engagement and can be readily inserted with bias into a contact support, so as to form a set of contact elements.

In a third aspect of the present invention a chipcard reader is provided using a contact support into which contact springs are inserted, so that they are, after insertion, biased.

As mentioned, the set of contact elements as well as the contact spring can be used in a connector for printed circuits, specifically flexible printed circuits.

BRIEF DESCRIPTION OF THE DRAWINGS

For a better understanding of the present invention reference may be made to the accompanying drawings in which.

DESCRIPTION OF THE PREFERRED EMBODIMENT

The invention will be described in connection with certain embodiments used for contacting the contact areas of a chipcard. However, the invention can also be used in different fields which require similar types of contacting, for instance, in connection with a connector for a flexible printed circuit.

Figure 1:
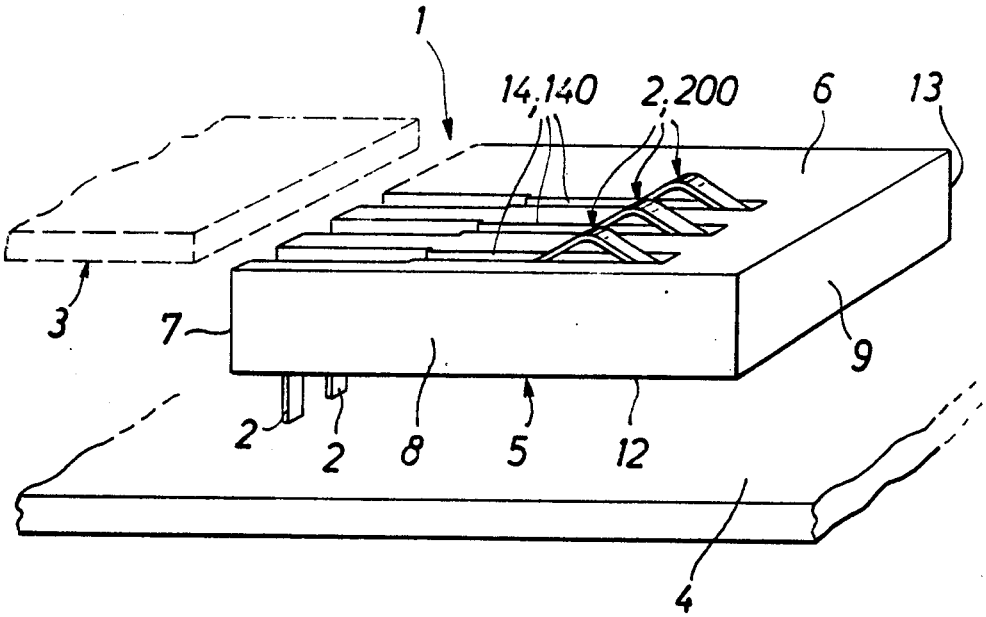
FIG. 1 is a perspective schematic representation of a set of contact elements intended to be used together with a chipcard.
Figure 2:
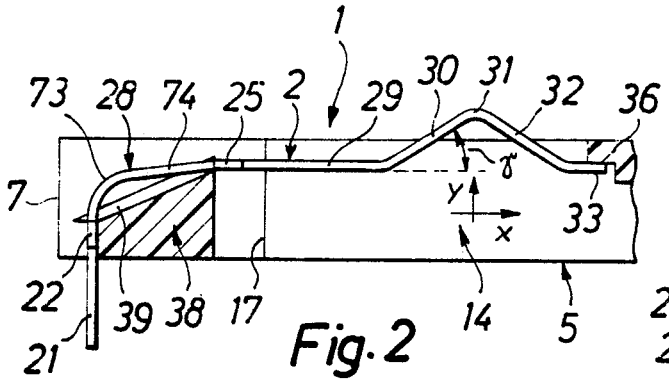
FIG. 2 is a partial cross-sectional view along line 2—2 in FIG. 3 of a first embodiment of a set of contact elements.

FIG. 1 shows schematically in a perspective representation a set 1 of contact springs 2 adapted to contact the contact areas (not shown) of a chipcard 3. In the following description the set 1 of contact elements 2 will be called a "contact set" 1, referring to a row of contacts 2 which are mounted in a contact support 5. The contact support 5, in turn, could form part of a chipcard reader. The chipcard reader would allow the proper insertion of the chipcard 3 for bringing the contact areas of the chipcard 3 into contact with the contact springs 2.

The contact set 1 is adapted to be connected with some apparatus, for instance, a telephone, which will make use of the data read from the chip of the chipcard 3. The lower ends of the contact springs 2 are connected for that purpose in a well-known manner to apparatus 4. FIG. 1 shows schematically not only the spring contacts 2 of the first embodiment of the invention, but also refers to the spring contacts 200 of a second embodiment of the invention. Similarly, FIG. 1 refers to guide grooves 14 of the first embodiment as well as guide grooves 140 of the second embodiment, both of which will be described later.

Before discussing the different embodiments of the invention it should be noted that the contact support 5 of FIG. 1 comprises an upper wall 6, a side wall 7, a front wall 8 and another (right) side wall 9 as well as a rear wall 13.

Figure 4:
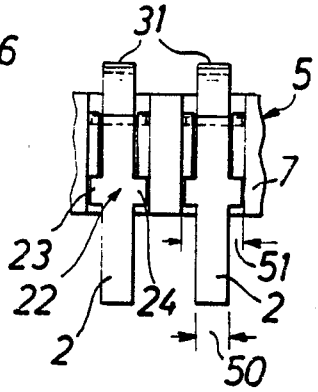
FIG. 4 is a front elevational view of the set of contact elements seen from the left side in FIG. 2.
Figure 3:
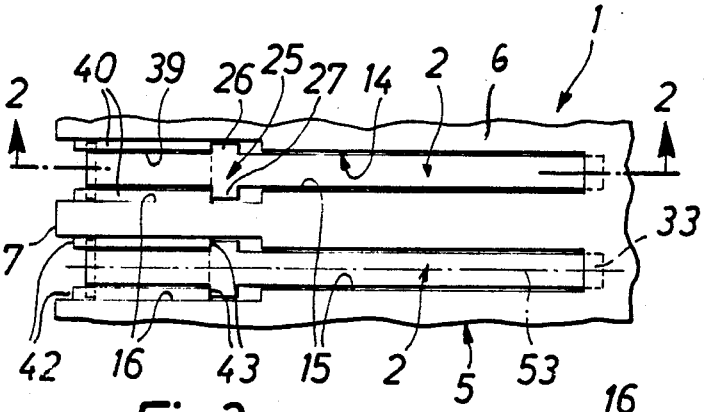
FIG. 3 is a plan view of the set of contact elements of FIG. 2.
Figure 5:
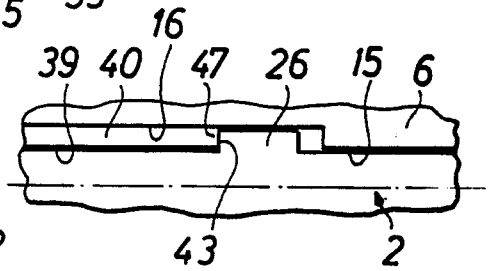
FIG. 5 is an enlarged partial view of FIG. 3.
Figure 6:
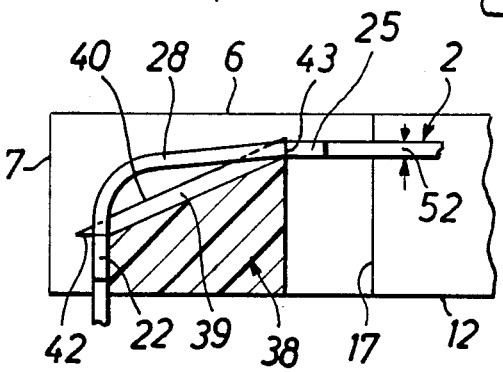
FIG. 6 is an enlarged part of FIG. 2.

A description of the first embodiment of the invention shown specifically in FIGS. 2 through 7 follows:

In the contact support 5 of the contact set 1 at least one contact spring 2, or preferably a plurality of contact springs 2, are mounted. In the upper wall 6 (see FIG. 3) guide grooves 14 are provided, adapted to receive contact springs 2. Each of guide grooves 14 includes a narrow portion 15 as well as a wider portion 16. The wider portion 16 continues in the side wall 7, as can be seen in FIG. 4. Reference numeral 17 (see FIG. 2) refers to the separating line between the narrower portion and the wider portion 16.

Prior to describing the contact support 5 in more detail, the contact spring 2 of the invention will be described. The contact spring 2 is preferably a stamped resilient metal strip. The contact spring 2 includes (see specifically FIG. 2), starting from the left, a termination portion 21 in the form of a solder termination portion. Then; continuing from the left in FIG. 2, the contact spring 2 includes second detent means 22 in the form of a second tab section 22 formed by means of two tabs 23, 24 (see FIG. 4). Adjacent to second tab section 22, an angular portion 28 (see FIGS. 2 and 6) can be recognized. Adjacent angular portion 28 is a first detent means in the form of a first tab section 25, which includes two tabs 26 and 27 (see FIG. 3). Adjacent to the first detent means 25, which extend substantially in the X-direction (see FIG. 3), is a longitudinal portion 29 which becomes a ramp portion 30 and a ramp portion 32 forming a cusp 31. Adjacent and to the right of cusp 31, the free end of the contact spring forms an abutment portion 33. The angle of ramp portion 30 is referred to by gamma.

While the longitudinal portion 29 extends substantially in the X-direction, the termination portion 21 extends substantially in Y-direction.

Figure 7:
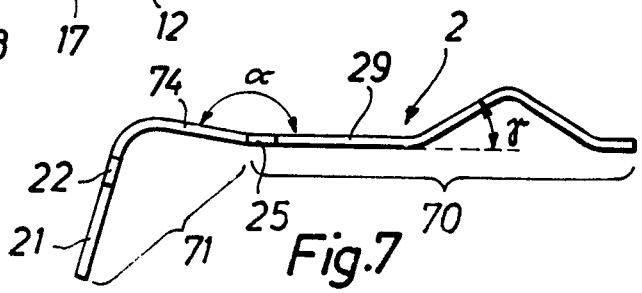
FIG. 7 is a side-view of the contact spring of the invention in its not yet assembled state.

Referring now to FIG. 7, it can be said that the contact spring 2 is formed by two spring legs, a first spring leg 70 and a second spring leg 71. Preferably, the leg 71 forms an angle of 90° with respect to the leg 70. From FIG. 2 it is clear that the angular portion 28 comprises a curved portion 73 and a straight portion 74. Further, FIG. 7 discloses that the straight portion 74 and the straight longitudinal portion 29 are not located on one line, but form an angle alpha which is smaller than 180°, for example 170°. FIG. 7 further discloses that the cusp shape of the contact spring (contact element) 2 forms a small ramp angle gamma which is, for instance, on the order of 30°, so that no deformation of the contact spring 2 occurs if the chipcard 3 comes into sliding engagement with contact spring 2.

FIG. 7 shows a contact spring 2 in its shape prior to the insertion into the contact support (housing) 5, while the other FIGS. 2–6 show the contact spring 2 in its shape after insertion into the contact support 5.

The contact spring 2 is symmetric with respect to center line 53 (see FIG. 3) and is located in the appropriate guide groove 14.

Having described the contact spring 2 in some detail, the contact support 5, which is preferably of a one-piece design, will be explained. The contact elements 2 can be inserted in such a manner that they are fixedly mounted due to the above detent means and, after being properly inserted, biased so that the spring characteristic of a contact spring (contact element) 2 starts with a force F which is larger than zero.

For locating the contact spring in the X-direction first counter detent means are provided in the form of two detent noses 43 at the contact support 5. In the illustrated embodiment the detent noses 42 are provided at a connecting member 38 of the contact support 5. First counter detent means 43 cooperate with the first detent means 25 of the contact spring 2.

For fixedly mounting the contact spring 2 in the Y-direction, second counter detent means 42 are provided in the form of two detent noses 42 which again are provided at the contact support 5, particularly the connecting member 38 of support 5. The noses 43 and 42, respectively, form detent surfaces which are offset with respect to each other by 90°. The second detent means 22 cooperate with second counter detent means 42.

The connecting member 38 and the contact support 5, respectively, form in the area of each of the contact springs two guide surfaces 40 in the form of inclined planes which extend between the first and second counter detent means 43 and 42, respectively. Between said two guide surfaces 40 (see FIG. 3) a groove section 39 is formed.

The first and second tab sections 25 and 22 have substantially the same shape and a width 51 (see FIG. 4) which corresponds substantially to the width of the widened portion 16, but is naturally somewhat smaller, so that the contact springs can be inserted. The width 50 (see FIG. 4) of the contact springs 2 corresponds substantially to the width of the smaller portion 15 of the guide groove 14, but is likewise somewhat smaller. Thus, a good guidance effect is provided for contact springs 2.

In accordance with the invention, the assembly of the contact springs 2 is carried out in accordance with the so-called "comb assembly technique", i. e. a comb of contact springs 2 is used. Such a comb of contact springs is generated during the stamping process, after which the individual contact springs 2 are still an integral part of a metal strip connecting all of the contact springs. This entire "comb" is placed on the contact support 5 such that initially the second detent means 22 are brought into engagement with the second counter detent means 42, whereupon the contact springs 2 are slidably pressed along the inclined plane 40 until the first detent means are inserted behind the first counter detent means 43, while at the same time the free ends of the springs, i. e. the abutment portions 33, are moved with bias (alpha=180°) under the abutment means in the form of an angular bar 36, so that the tabs 26, 27 of the first tab section 25 positively engaged with the widened portions of the guide groove (groove section 39), i. e. the detent noses 42.

FIGS. 8 through 11 disclose a second embodiment of the invention. The contact set is referred to by reference numeral 100 and the contact spring is referred to by reference numeral 200. Similar to the first embodiment, a contact support 500 is provided. The upper wall of the contact support is referred to by reference numeral 6 similar to FIG. 1.

Again, similar to the first embodiment, guide grooves 140 (referred to with reference numeral 14 in the first embodiment) are provided, which could also be called contact chambers. Contact springs 200 are located in guide grooves 140. The wider portion of a guide groove 140 is referred to by reference numeral 160 (see FIG. 9).

Again, similar to the first embodiment, an angular bar 36 provides abutment means for the free end or abutment portion 33 of the contact element 200.

Also, a connecting member 380, similar to contacting member 38 in the first embodiment, is provided but forms here only one counter detent means in the form of two detent noses 430. Similar to what was described in connection with FIG. 6, the second embodiment features a guide surface 400 similar to guide surface 40 of the first embodiment. Offset in upward and in leftward direction (see FIG. 8) with respect to the upper end of the connecting member 38, a cross member or abutment means 80 is provided, and the contact spring 200 is in contact with the bottom side of said contact means 80.

It is to be noted that the contact spring 200 is of a somewhat different design than the contact spring of FIG. 7. The first contact legs 70 of both springs 2 and 200 are of identical design, but the second leg 710 of the spring 200 is simply a straight portion 48 which does not possess a portion corresponding to the angular portion 28 of spring 2.

The straight portion 48 is used as a termination portion Preferably, (see FIG. 11) an angle alpha in the range of 170° is formed between the straight portion 48 and the longitudinal portion 29 of the first leg 70. The contact spring 200 includes only a first detent means in the form of a first detent section 25, the detent section 25 again including similarly to contact spring 2, tabs 26 and 27. The tab section 25 is preferably located just in the longitudinal portion 29, so that the angular deflection about the angle alpha occurs only to the left (see FIG. 11) adjacent to the tab section 25.

It is also conceivable to use a contact spring 200 having an angle alpha of 180°. For such a modification the arrangement of cross bar 80 and of bar 36, as well as of the upper abutment surface of tab member 380, is selected such that the spring 200 is biased after being inserted.

The second embodiment discloses that the principle of a biased spring can also be used for a straight, spring contact. In this case the detent means 25 instead of the noses 42 provide for abutment in both longitudinal directions. An opposing bearing means is provided for creating the bias, and the cross bar 80 is used in connection with the contact support 500.

Figure 12:
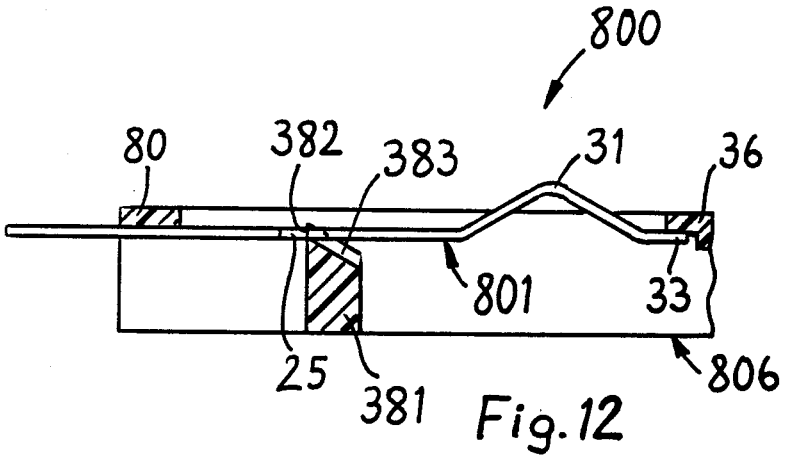
FIG. 12 shows schematically a third embodiment of the invention, which is a modification of the second embodiment.

FIG. 12 discloses a third embodiment of a contact set 800 which comprises a contact support 806 and contact springs 801. Contact spring 801 is substantially similar to contact spring 200 shown in FIG. 11; i.e. in the position shown in FIG. 12 the contact spring 801 is in its biased condition.

Figure 8:
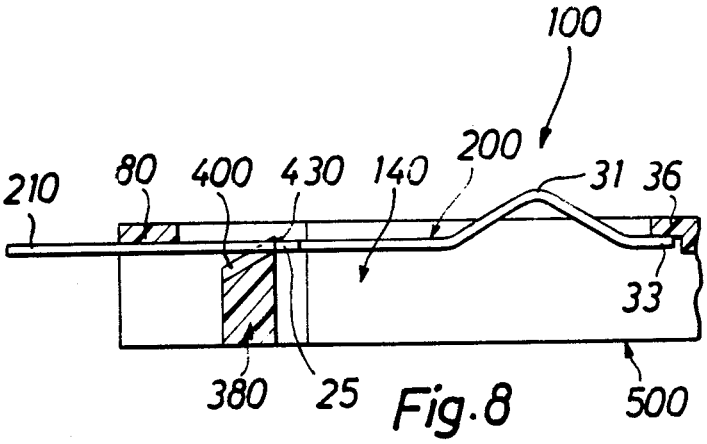
FIG. 8 is a sectional view similar to FIG. 2, but of a second embodiment of a set of contact elements.
Figure 10:
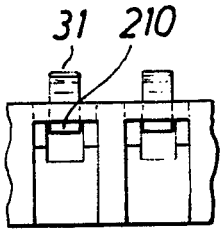
FIG. 10 is a side elevational view from the left in FIG. 8.
Figure 9:
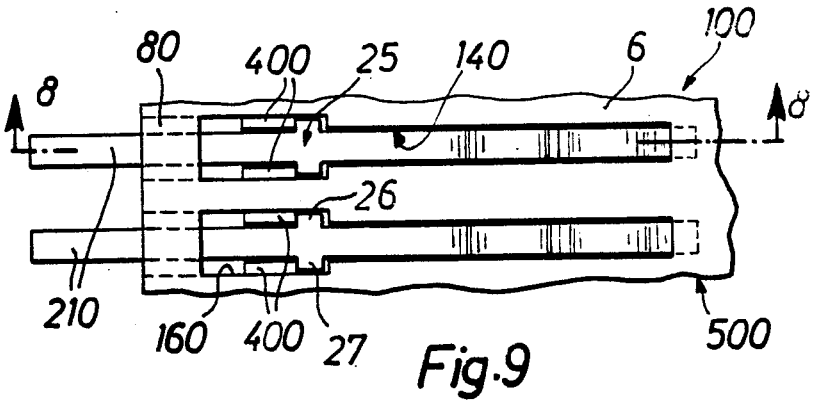
FIG. 9 is a top plan view of the second embodiment of FIG. 8.
Figure 11:
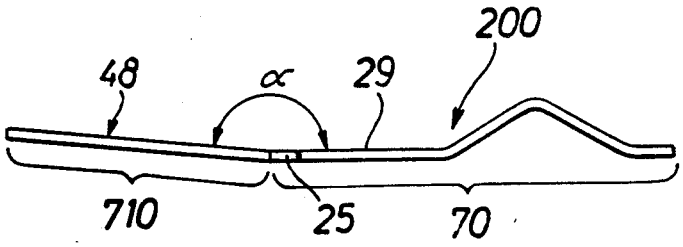
FIG. 11 is a side view of a contact spring in accordance with a second embodiment of the invention.

There are other similarities between the embodiment of FIG. 12 and the embodiment of FIG. 8. The abutment means 80 of FIG. 12 are similar to the abutment means 80 of FIG. 8, and the same is true for the angular tab member 36. Connecting member 381 of FIG. 12 is of mirror-like design to the connecting member 380 of FIG. 8. Thus, the connecting member 381 includes an abutment surface 382 located on the right-hand side of tabs, 25 of the spring 801. Connecting member 381 further includes guide surfaces 383 similar to the guide surfaces 400 of FIGS. 8 and 9. In the embodiment of FIG. 12, the contact springs 801 are inserted from the right with the tabs 25 sliding along the ramp-shaped guide surfaces 383 until the tabs 25 come into engagement with the abutment surfaces 382.

We claim:

1. A contact spring consisting essentially of a resilient metal strip, said resilient metal strip comprising:

detent means for mounting the contact spring in a contact support having an open guide groove with a generally longitudinally extending opening and a plurality of counter detents arranged such that said contact spring may initially be inserted into said guide groove through the groove opening;

a first and a second spring leg; and a contact cusp formed by said first spring leg, wherein said detent means is provided at a transition between the first and second spring legs, said contact spring is adapted to be mounted in said contact support in a biased condition, and said cusp comprises a small angle $\gamma$ of contact.

2. The spring of claim 1 wherein an angle between said first and second spring legs include an obtuse angle $\alpha$.

3. The spring of claim 1, wherein said spring is of integral or one-piece design and has a form which is symmetric with respect to a center line of the strip.

4. The contact spring of claim 1 wherein said contact springs are formed by stamping a connecting strip for a plurality of contact springs such that comb-like structures are formed which are adapted to be inserted into a contact support, after which the said connecting strip is removed.

5. The contact spring of claim 1 wherein said cusp is of symmetric design.

6. The contact spring of claim 1 wherein said first spring leg forms an angle $\alpha$ of approximately 170° with respect to said second spring leg, in an unbiased condition.

7. The contact spring of claim 1 wherein said first spring leg forms an angle $\alpha$ of approximately 175° with respect to said spring leg, in an unbiased condition.

8. The contact spring of claim 1 wherein the width of the contact spring is approximately three times the thickness of the contact spring.

9. The contact spring of claim 1 wherein the width of the contact spring in the area of the tab sections is about twice the width of the spring outside of said tab sections.

10. The contact spring of claim 1, wherein said first and second detent means are identical.

11. The spring of claim 1 wherein said detent means is provided in the form of a tab section.

12. The contact of claim 11 wherein each tab section comprises two tabs arranged symmetrically with respect to said center line.

13. The contact spring of claim 1 wherein said second spring leg is of a straight line design.

14. The contact spring of claim 13 wherein a transition section having an angle $\alpha$ between the first and second spring legs is adjacent to said tab section.

15. A contact spring comprising:

a metal strip, detent means provided by said metal strip for locating said contact spring in a contact spring receiving contact support having an open guide groove with a generally longitudinally extending opening and a plurality of counter detents arranged such that said contact spring may initially be inserted into said guide groove through the groove opening, a first and a second spring leg, wherein one of the spring legs forms a nonzero angle with respect to sadi other spring leg, said detent means being provided in the area of the second spring leg, and a contact cusp formed by said first spring leg adjacent to a free end of said first spring leg which forms an abutment portion.

16. The contact spring of claim 15, wherein, two tab sections are provided, a first tab section and a second tab section, one tab section being formed in said first spring leg, while the second tab section is being formed in said second spring leg.

17. The contact spring of claim 15, wherein the angle between said first and second leg is approximately 90°.

18. The spring of claim 15, wherein, in the area of said first spring leg, a second detent means for locating said contact spring is provided.

19. The contact spring of claim 18, wherein, adjacent to said second detent means, a soldering termination portion is provided.

20. An assembly for mounting a set of contact elements comprising:

a contact support and at least one contact spring, said contact spring being of integral design and including means for fixedly mounting said contact spring in said contact support by means of a "comb assembling technique".

21. The assembly of claim 20 wherein said contact springs are biased after being mounted in said contact support.

22. The assembly of claim 20 wherein said contact springs comprise;

detent means for mounting the contact spring in said contact support, said contact support having open guide grooves with generally longitudinally extending openings arranged such that said contact spring may initially be inserted into said guide grooves through the groove openings;

a first and a second spring leg provided at a nonzero angle in respect to the first leg; and a contact cusp formed by said first spring leg, wherein said detent means is provided at a transition between the first and second spring legs, said contact spring is adapted to be mounted in said contact support in a biased condition, and said cusp comprises a small angle $\gamma$ of contact.

23. The assembly of claim 22 wherein the bias of spring in the mounted position is generated by providing an angle $\alpha$ between the first and second legs in an unmounted condition of the contact spring.

24. The assembly of claim 23, wherein the bias of the spring is provided in such a manner that a first abutment means on said spring for abutting said contact support is offset with respect to mounting of the contact spring by means of second and third abutment means on said contact support for abutting said spring.

25. The assembly of claim 20 wherein said contact support comprises counter detent means for cooperating with said detent means of said contact elements to mount the contact spring in the guide above.

26. The assembly of claim 25 wherein said counter detent means are spaced from each other in a first direction located at different levels in a direction transverse to said first direction.

27. The assembly of claim 25 wherein said noses are formed at a connecting member of said contact support.

28. The assembly of claim 25 wherein each of two counter detent means are formed by spaced apart noses.

29. The assembly of claim 25 wherein the contact spring is inserted into said contact support in such a manner that the detent means of the contact springs are in positive engagement with said counter detent means.

30. The assembly of claim 29 wherein said counter detent means are formed by noses of the contact support.

31. The assembly of claim 25 wherein, adjacent to said counter detent means guide means, are provided for allowing, during assembly, a sliding motion of the contact spring along said guide means until the detent means come into engagement with said counter detent means.

32. The assembly of claim 31 wherein the contact support comprises for each contact element a guide groove arranged in an upper wall of the contact support, and wherein each guide groove comprises a narrow portion and adjacent thereto a wide portion.

33. The assembly of claim 31 wherein said guide means have guide surfaces in the form of an inclined plane.

34. The assembly of claim 33 wherein the guide surfaces are formed at a connecting member.

35. The assembly of claim 20 wherein said contact support comprises abutment means for abutting a free end of the contact spring.

36. The assembly of claim 35 wherein each contact element is tensioned between two points and are biased with respect to abutment means.

37. The assembly of claim 20 wherein a connecting member is provided which forms counter detent means for cooperating with detent means of the contact spring to mount the contact spring in said contact support.

38. The assembly of claim 19 wherein said connecting member comprises guide surfaces in the form of inclined planes, so as to guide said detent means of the spring into a detent or rest position.

39. The assembly of claim 38, wherein said counter detent means are provided in the form of two detent noses.

40. The assembly of in claim 37, wherein an abutment means is provided for securely mounting a straight portion of the contact spring is securely mounted so as to be biased with its free end against abutment means.

41. The assembly of claim 40 wherein the contact spring is in abutment with the bottom side of the abutment means, is located on a connecting portion, and is held with respect to said connecting member by means of a tab section.

42. A chipcard reader using a set of contact elements comprising:

a contact support and at least one contact spring, said contact spring being of integral design and means for fixedly mounting said contact spring in said contact support by means of the "comb assembling technique".

* * * * *